US005084665A

United States Patent [19]

Dixon et al.

[11] Patent Number: 5,084,665

[45] Date of Patent: Jan. 28, 1992

[54] VOLTAGE REFERENCE CIRCUIT WITH POWER SUPPLY COMPENSATION

[75] Inventors: Robert P. Dixon, Chandler; Walter C. Seelbach, Fountain Hills, both of Ariz.

[73] Assignee: Motorola, Inc., Schaumburg, Ill.

[21] Appl. No.: 533,199

[22] Filed: Jun. 4, 1990

[51] Int. Cl.[5] ..... G05F 1/567; G05F 5/08

[52] U.S. Cl. ..... 323/281; 323/303; 323/314; 323/901; 323/907

[58] Field of Search ..... 323/281, 303, 314, 901, 323/907

[56] References Cited

U.S. PATENT DOCUMENTS 3,671,770 6/1972 Frederiksen .
4,447,784 5/1984 Dobkin ..... 323/313
4,450,514 5/1984 Peruth ..... 363/49
4,792,749 12/1988 Kitagawa et al. ..... 323/314
4,906,863 3/1990 Tran ..... 307/296.7

*Primary Examiner*—William H. Beha, Jr.
*Attorney, Agent, or Firm*—Bradley J. Botsch

[57] ABSTRACT

A BiMOS voltage reference circuit which includes a bandgap circuit for providing a predetermined voltage at an output of the circuit that is independent of temperature. A start-up and bias circuit coupled to the bandgap circuit for providing a start-up current to the bandgap circuit during power-up and for providing a bias current to the bandgap circuit after power-up. A feedback circuit coupled to the bandgap circuit for maintaining the bias current to the bandgap circuit independent of power supply variations wherein the predetermined voltage at the output of the circuit is also independent of power supply variations as well as temperature.

16 Claims, 2 Drawing Sheets

VOLTAGE REFERENCE CIRCUIT WITH POWER SUPPLY COMPENSATION

BACKGROUND OF THE INVENTION

This invention relates to voltage reference circuits and, in particular, to bandgap voltage reference circuits which are compensated for power supply voltage variations.

Bandgap voltage reference circuits are well known and widely used in the art and typically provide an output voltage that is independent of temperature. The output voltage has substantially zero temperature coefficient and is produced by summing together two voltages such that one of the voltages has a positive temperature coefficient while other has a negative temperature coefficient.

In general, the positive temperature coefficient is produced by using first and second transistors operating at different current densities such that the first transistor is operating at a lower current density than the second transistor. By connecting a resistor in series with the emitter of the first transistor and then coupling the base of the first transistor and the other end of the resistor across the base and emitter of the second transistor, a delta $V_{BE}$ voltage across the resistor is produced that has a positive temperature coefficient. This positive temperature coefficient voltage is combined in series with the $V_{BE}$ voltage of a third transistor which has a negative temperature coefficient such that a composite output voltage having a very low or zero temperature coefficient is provided. This third transistor typically has its base coupled to collector of the first transistor, an emitter coupled to a first supply voltage terminal and a collector coupled to a second supply voltage terminal through a load resistor. Further, this third transistor is responsible for absorbing the change in current which is caused by power supply variation. Therefore, as a power supply increases, the current through the third transistor increases, thereby resulting in a increased $V_{BE}$ voltage across the third transistor. This increased $V_{BE}$ voltage of the third transistor then causes the output voltage of the bandgap circuit to increase. Therefore, it can be said that a positive slope function exists for the output voltage of the bandgap circuit as a function of power supply variation and, in general, the output voltage of a bandgap circuit is not independent of power supply variations.

One improvement that prior art has made to the bandgap circuit in order to reduce its output voltage dependence with respect to power supply variations utilizes a shunt PNP transistor and is fully described in U.S. Pat. No. 3,617,859, entitled "Electrical Regulator Apparatus Including A Zero Temperature Coefficient Voltage Reference Circuit", by Robert C. Dobkin and assigned to National Semiconductor Corporation. However, though this solution may work theoretically, it is not practical since typically a PNP transistor requires a much larger area than an NPN transistor and is typically much more difficult to fabricate.

Another improvement that prior art has made to the bandgap circuit in order to reduce its output voltage dependence with respect to power supply variations is fully described in U.S. Pat. No. 4,628,248, entitled "NPN Bandgap Voltage Generator", by Mark S. Birritella et al and assigned to Motorola Inc. This describes an all NPN transistor approach to compensate for power supply variations which has the negative result of substantially increasing the number of components and size of the voltage reference circuit.

Yet another improvement that prior art has made to the bandgap circuit in order to reduce its output dependence with respect to power supply variation is disclosed in IEEE International Solid State Circuit Conference on Thursday, Feb. 16, 1989 on pages 120–121 by Texas Instruments, Inc. in Dallas, Tex. However, the output voltage of the bandgap circuit does vary with temperature as is clearly shown in FIG. 4 of the article. Therefore, some compensation for power supply variations has been attained, but at the cost of a loss of temperature compensation.

Still another improvement that prior art has made to the bandgap voltage reference circuit in order to reduce its output voltage dependence with respect to power supply variations is disclosed in IEEE Journal of Solid State Circuits, Volume 23, No. 5, Oct. 19, 1988, entitled "A 4-Ns 4K×1-Bit two-Port BiCMOS SRAM" by Yang. The circuit shown in FIG. 12 does provide some compensation for power supply variations, however, as stated in the article, simulations show that the reference output voltage changes about six millivolts for a one volt change in the power supply. For many applications, this change in output voltage may be too large and unacceptable.

Hence, a need exists for a voltage reference circuit having an output voltage that is independent of temperature and power supply variations.

SUMMARY OF THE INVENTION

Accordingly, it is an object of the present invention to provide an improved voltage reference circuit.

Another object of the present invention is to provide a voltage reference circuit that provides an output voltage that is independent of power supply variations.

Yet another object of the present invention is to provide a voltage reference circuit that provides an output voltage that is independent of temperature.

Still yet another object of the present invention is to provide a voltage reference circuit having a controllable slope of its output voltage as a function of power supply variation.

Even yet another object of the present invention is to provide a voltage reference circuit having a negative slope of its output voltage as a function of power supply variation.

In carrying out the above and other objects of the present invention there is provided a circuit having an output comprising a bandgap circuit for providing a predetermined voltage at an output; a start-up and bias circuit coupled to the bandgap circuit for providing a start-up current to the bandgap circuit during power-up and for providing a bias current to the bandgap circuit after power-up; a feedback circuit coupled to the bandgap circuit for maintaining the bias current through the bandgap circuit constant and independent of power supply variations; and an output circuit coupled to the output of the bandgap circuit for providing an output voltage at the output of the circuit, the output voltage at the output of the circuit is independent of temperature and power supply variations.

The above and other objects, features and advantages of the present invention will be better understood from the following detailed description taken in conjunction with the accompanying drawings.

DETAILED DESCRIPTION OF THE PREFERRED EMBODIMENT

Figure 1:
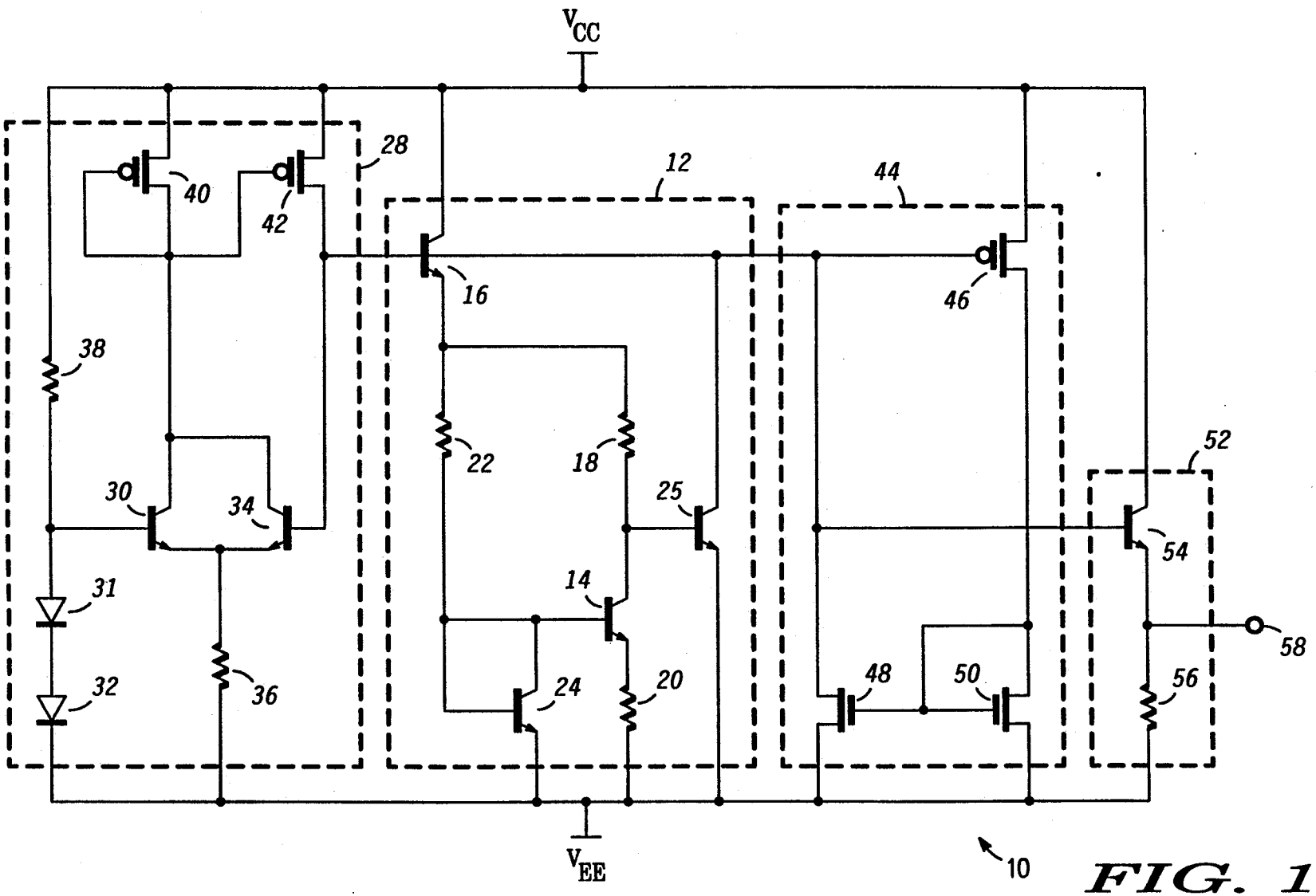
FIG. 1 is a detailed schematic diagram illustrating a first embodiment of the voltage reference circuit of the present invention.

Referring to FIG. 1, a detailed schematic diagram illustrating a first embodiment of the voltage reference circuit 10 of the present invention is shown comprising bandgap circuit 12 which includes transistor 14 having a collector coupled to the emitter of transistor 16 by resistor 18, and an emitter coupled, through resistor 20, to a first supply voltage terminal at which the operating potential $V_{EE}$ is applied. The base of transistor 14 is coupled to the emitter of transistor 16 by resistor 22 and to a base and a collector of transistor 24. The emitter of transistor 24 is coupled to operating potential $V_{EE}$. The collector of transistor 14 is further coupled to the base of transistor 25, the latter having an emitter coupled to operating potential $V_{EE}$ and a collector coupled to the base of transistor 16. The collector of transistor 16 is coupled to a second supply voltage terminal at which the operating potential $V_{CC}$ is applied. It is worth noting that operating potential $V_{CC}$ is typically ground reference for the circuit in FIG. 1 and that power supply variations are typically due to the variations in operating potential $V_{EE}$. However, operating potential $V_{EE}$ could be coupled to ground reference while power supply variations would be due to the variations in operating potential $V_{CC}$.

Voltage reference circuit 10 further comprises start-up and bias circuit 28 which includes transistor 30 having a base coupled to operating potential $V_{EE}$ by the series combination of diodes 31 and 32, and to operating potential $V_{CC}$ by resistor 38. The emitter of transistor 30 is coupled to an emitter of transistor 34 and to operating potential $V_{EE}$ by resistor 36. The collector of transistor 30 is coupled to the collector of transistor 34 and to the gate and drain electrodes of PMOS transistor 40. The drain electrode of PMOS transistor 40 is further coupled to the gate electrode of PMOS transistor 42. The source electrodes of PMOS transistors 40 and 42 are coupled to operating potential $V_{CC}$. The drain electrode of MOS transistor 42 is coupled to the base of transistor 34 and to the base of transistor 16 of bandgap circuit 12.

Voltage reference circuit 10 further comprises feedback circuit 44 which includes PMOS transistor 46 having a gate electrode coupled to the base of transistor 16 and to the drain electrode of NMOS transistor 48. The source electrode of PMOS transistor 46 is coupled to operating potential $V_{CC}$ and its drain electrode is coupled to the gate and drain electrodes of NMOS transistor 50. The gate electrode of NMOS transistor 48 is coupled to the gate electrode of NMOS transistor 50 while the source electrodes of NMOS transistors 48 and 50 are coupled to operating potential $V_{EE}$.

Voltage reference circuit 10 further comprises output circuit 52 which includes transistor 54 having a collector coupled to operating potential $V_{CC}$ and a base coupled to the base of transistor 16 at which an output of bandgap circuit 12 is provided. The emitter of transistor 54 is coupled to operating potential $V_{EE}$ by resistor 56 and to output terminal 58.

In operation, voltage reference circuit 10 is a BiMOS circuit that provides a constant output voltage at output terminal 58, substantially equal to the bandgap voltage of silicon, that is independent of both temperature and power supply variations. Furthermore, voltage reference circuit 10 is typically used to provide a voltage that will drive respective current sources of ECL logic circuits in order to provide constant $V_{OH}$, $V_{OL}$ and $V_{BB}$ voltage levels, where $V_{OH}$ and $V_{OL}$ are the respective output voltage levels of a logic high state and a logic low state, while $V_{BB}$ is the midpoint threshold voltage level between the two output voltage levels.

Bandgap circuit 12 operates in the following manner. Transistor 14 and diode connected transistor 24 operate at different current densities as determined by the ratio of resistors 18 and 22 and their relative emitter areas. Transistor 14 operates at a lower current density than transistor 24. Due to this difference in current densities, a delta $V_{BE}$ voltage is produced across resistor 20 that has a positive temperature coefficient, as is understood. Furthermore, it is known that transistor 25 has a negative temperature coefficient and, thus, when the $V_{BE}$ voltage of transistor 25 is combined in series with the positive temperature coefficient voltage drop across resistor 18 which is due to the collector current of transistor 14 as shown in FIG. 1, a voltage having a very low or zero temperature coefficient is achieved at the emitter of transistor 16. Therefore, bandgap circuit 12 provides a voltage at the emitter of transistor 16 that is independent of temperature and is substantially equal to the bandgap voltage ($V_{BGAP}$) of silicon semiconductor material, i.e., approximately 1.2 volts as is generally known. It should be apparent that this voltage is also present at output terminal 58 via the cancelling base-emitter junction voltages of transistors 16 and 54. Therefore, the output voltage at output terminal 58 is independent of temperature. However, it is important to realize that power supply voltage variations will cause the collector-emitter current of transistor 16 as well as the source-drain current of PMOS transistor 42 to vary which will cause the current through transistor 25 to vary. Furthermore, a varying current through transistor 25 will vary its $V_{BE}$ voltage thereby varying the voltage at the emitter of transistor 16 and, thus, the output voltage at output terminal 58. Therefore, bandgap circuit 12 alone does not provide an output voltage that is completely independent of power supply variations. Thus, the improvements to bandgap circuit 12 include start-up and bias circuit 28 and feedback circuit 44 such that a constant bias current through transistor 25 is maintained and, consequently, the output voltage at output terminal 58 is independent of temperature as well as power supply variations.

Start-up and bias circuit 28 performs a dual function as its title implies. First, upon power up, start-up and bias circuit 28 functions as an initialization circuit to provide a seed current to PMOS transistor 40. Second, after power-up, start-up and bias circuit 28 functions as a current source to provide a bias current to bandgap circuit 12 and, in particular, through transistor 25. The start-up function is accomplished by diodes 31 and 32 and resistor 38 which, upon power-up, provides a predetermined voltage at the base of transistor 30 as determined by the voltage across diodes 31 and 32, thereby rendering transistor 30 operative while transistor 34 will be rendered non-operative. Since transistor 30 is operative, it will provide a predetermined seed current to PMOS transistor 40 as determined by the predetermined voltage applied at the base of transistor 30. This predetermined seed current is mirrored through PMOS transistor 42 and then provided to bandgap circuit 12. Bandgap circuit 12 will now start functioning and the voltage at the emitter of transistor 16 will eventually increase to the bandgap voltage ($V_{BGAP}$) of silicon. When the voltage at the base of transistor 34 rises above the predetermined voltage at the base of transistor 30, the comparator circuit, comprised of transistors 30 and 34, will switch, thereby rendering transistor 34 operative and transistor 30 non-operative. It is now important to realize that the voltage at the base of transistor 16 will be substantially equal to the bandgap voltage ($V_{BGAP}$) plus a base-emitter voltage which occurs across transistor 16. Furthermore, the voltage across resistor 36 is substantially equal to the bandgap voltage ($V_{BGAP}$) due to the base-emitter voltage drop across transistor 34. Therefore, since the voltage across resistor 36 is independent of temperature, the current flowing through transistor 34 and PMOS transistor 40 is also independent of temperature. This current is then mirrored through PMOS transistor 42 which supplies a current through transistor 25 that is independent of temperature. Thus, start-up and bias circuit 28 now functions as a current source for providing a bias current to bandgap circuit 12.

Although start-up and bias circuit 28 provides substantial compensation for the output voltage at output terminal 58 for power supply variations, PMOS transistor 42 and transistor 16 are not ideal devices and, thus, they do not provide a current through transistor 25 that is independent of power supply variations. As an illustration, if the power supply voltage increase, the saturation current of PMOS transistor 42 increases, thereby increasing the current through transistor 25. As an example for the circuit in FIG. 1, the output voltage at output terminal 58 typically changes 2 volts per one volt change in the power supply. However, it is a goal of voltage reference circuit 10 to provide a constant current through transistor 25 that is independent of temperature and power supply variations in order to provide a voltage at output terminal 58 that is also independent of temperature and power supply variations.

Feedback circuit 44 allows the current through transistor 25 to be substantially constant with power supply variations which, in turn, allows the output voltage at output terminal 58 to be substantially constant with power supply variations. This is accomplished by having the gate electrode of PMOS transistor 46 coupled to the base of transistor 16 and the source electrode of PMOS transistor 46 coupled to operating potential $V_{CC}$ such that any power supply variation produces a gate-source electrode voltage variation in PMOS transistor 46. Therefore, if the power supply voltage increases, the gate-source electrode voltage of PMOS transistor 46 increases thereby increasing the current through PMOS transistor 46 and providing an increasing current through NMOS transistor 50. The current through NMOS transistor 50 is then mirrored through NMOS transistor 48 which functions to absorb or sink the increasing current that was caused by the increase in the power supply voltage. Thus, the current through transistor 25 is maintained substantially constant since the increasing current is passed through NMOS transistor 48. On the other hand, if the power supply voltage decreases, the gate-source electrode voltage of PMOS transistor 46 decreases thereby decreasing the currents through PMOS transistor 46 and NMOS transistor 50. This current is then mirrored through NMOS transistor 48 which functions to sink less current so as to maintain a substantially constant current through transistor 25. It should be apparent that the bias current through transistor 25 is maintained constant for variations in the power supply and, consequently, the voltage at output terminal 58 is also maintained constant with respect to power supply variations. Or equivalently, a zero slope is achieved for the output voltage at output terminal 58 as a function of power supply variation.

It is worth noting, if so desired, that some of the bias current flowing through transistor 25 can actually be robbed or steered away by adjusting the gain of the current mirror comprised of NMOS transistors 48 and 50 by, for example, adjusting the relative areas of transistors 48 and 50. This would allow one to obtain a voltage at output terminal 58 that would actually decrease with an increase in power supply voltage thereby providing a negative slope for the output voltage at output terminal 58 as a function of power supply variation.

Figure 2:
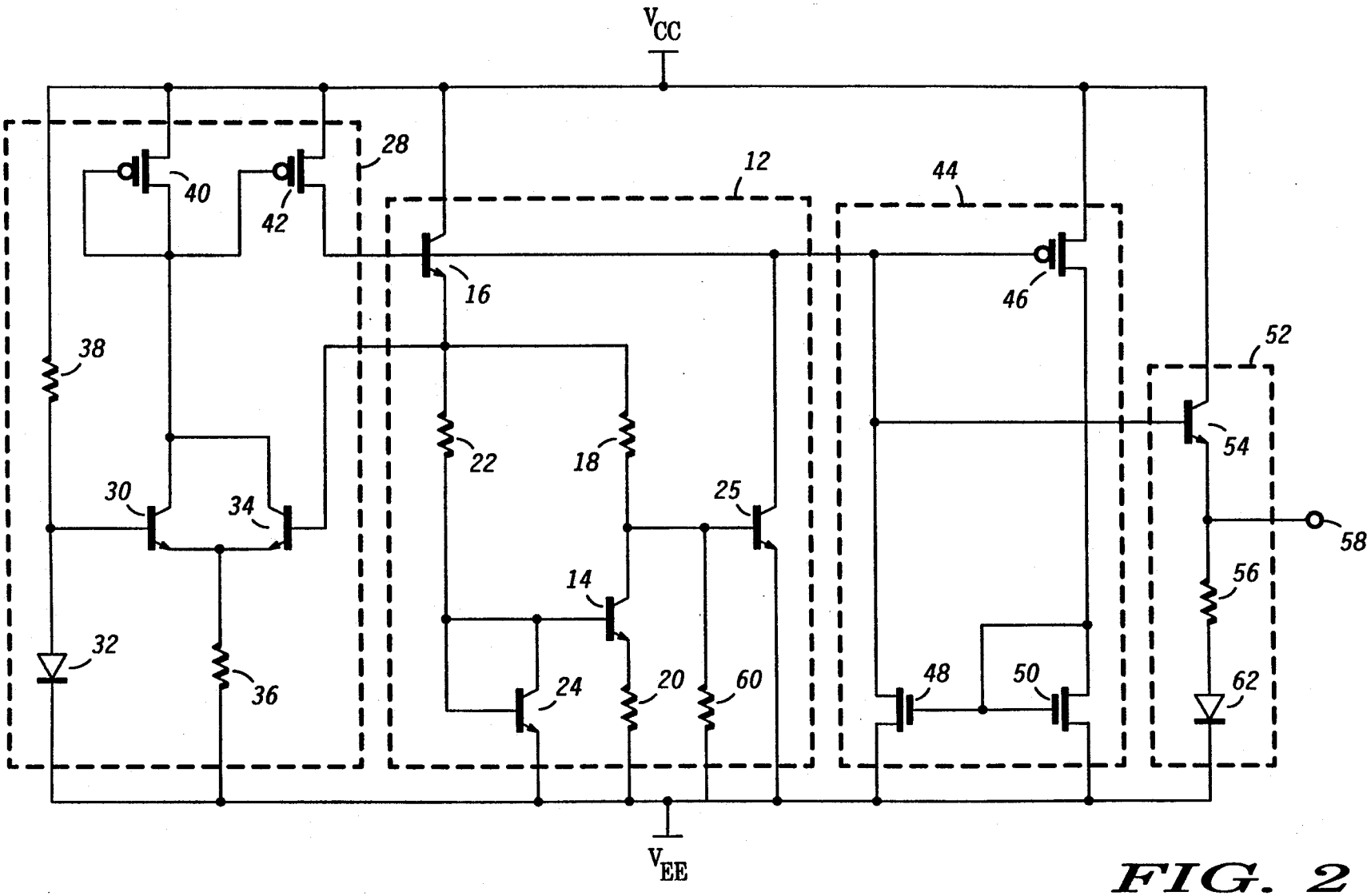
FIG. 2 is a detailed schematic diagram illustrating a second embodiment of the voltage reference circuit of the present invention.

Referring to FIG. 2, a detailed schematic diagram illustrating a second embodiment of the voltage reference circuit of the present invention is shown, it is understood that components similar to those of FIG. 1 are designated by the same reference numerals. The alternate embodiment in FIG. 2 further comprises resistor 60 coupled between the base of transistor 25 and operating potential $V_{EE}$ and diode 62 coupled between resistor 56 and operating potential $V_{EE}$. In addition, the circuit of FIG. 2 differs from the circuit in FIG. 1 in that the base of transistor 34 is now coupled to the emitter of transistor 16 instead of the base of transistor 16 as was shown in FIG. 1. Also, diode 31 has been removed to provide a lower predetermined voltage at the base of transistor 30 as is shown in FIG. 1.

In operation, the circuit in FIG. 2 is another BiMOS circuit and is typically used to provide a voltage that will drive respective current sources of ECL logic circuits in order to provide constant logic swings. Thus, the circuit in FIG. 2 provides an output voltage at output terminal 58 that is independent of power supply variations but not independent of temperature and is calculated below.

$$V_{OUT}=(K\times V_{BGAP})+V_{BE} \quad (1)$$

where

K is a constant, typically less than unity;

$V_{BGAP}$ is the bandgap voltage of silicon; and $V_{BE}$ is the base-emitter voltage of transistor 25.

Without resistor 60, the voltage at the emitter of transistor 16 is substantially equal to the bandgap voltage as was mentioned for the circuit in FIG. 1. However, with the addition of resistor 60, the voltage across resistor 18 is substantially equal to the bandgap voltage multiplied by a scaling factor K, where K is determined by the ratios of resistor 18 and 60 and is typically less than unity. Thus, the voltage at the emitter of transistor 16 is substantially equal to ($K\times V_{BGAP}$) plus the $V_{BE}$ voltage of transistor 25. It should be apparent that this voltage is also present at output terminal 58 via the cancelling base-emitter junction voltages of transistors 16 and 54. Start-up and bias circuit 28 and feedback circuit 44 are structurally and functionally equivalent to start-up and bias circuit 28 and feedback circuit 44 for the circuit in FIG. 1 with the exception that the base of transistor 34 is now coupled to the emitter of transistor 16 as shown in FIG. 2. This is due to the fact that in order to provide a constant bias current to bandgap circuit 12 and, in particular, through transistor 25, a constant voltage must be maintained across resistor 36 which is independent of temperature. Therefore, since a voltage substantially equal to $(K \times V_{BGAP}) + a\ V_{BE}$ voltage is provided at the emitter of transistor 16, a voltage substantially equal to $(K \times V_{BGAP})$ is provided across resistor 36. This voltage is substantially constant and will maintain a substantially constant current through transistor 34 and PMOS transistor 40.

The operation of start-up and bias circuit 28 provides both a seed current to PMOS transistor 40 upon power-up and then a bias current through transistor 25 after power-up, as was aforedescribed for the circuit in FIG. 1. Furthermore, feedback circuit 44 maintains a substantially constant current through transistor 25 as was also aforedescribed for the circuit in FIG. 1. Therefore, since a substantially constant current is maintained through transistor 25, the output voltage at output terminal 58 is independent of power supply variation. However, due to the $V_{BE}$ term comprising the output voltage as shown in Eqn. (1), the output voltage at output terminal 58 of FIG. 2 is not independent of temperature.

Hence, it should be apparent from the foregoing discussion that a novel voltage reference circuit has been provided having an output voltage that is independent of both temperature and power supply variations. It should also be apparent from the foregoing discussion that a novel circuit has been provided having an output voltage for driving current sources of logic circuits for providing constant logic swings that are independent of power supply variations.

What is claimed is:

1. A circuit having an output, comprising;

circuit means for providing a predetermined voltage at an output, said predetermined voltage being substantially independent of temperature;

start-up and bias circuit means coupled to said circuit means for providing a start-up current to said circuit means during power-up and for providing a bias current to said circuit means after power-up, said bias current being generated from said predetermined voltage of said circuit means;

feedback means coupled to said circuit means for maintaining said bias current to said circuit means substantially independent of power supply variations; and output means coupled to said circuit means for providing a predetermined output voltage at the output of the circuit, said predetermined output voltage being independent of temperature and power supply variations.

2. The circuit according to claim 1 wherein said start-up and bias circuit means includes:

a first transistor having a collector, a base and an emitter, said base being coupled to first and second supply voltage terminals, and said emitter being coupled to said first supply voltage terminal;

a second transistor having a collector, a base and an emitter, said collector being coupled to said collector of said first transistor, and said emitter being coupled to said emitter of said first transistor;

a third transistor having first, second and control electrodes, said first electrode being coupled to said second supply voltage terminal, and said second and control electrodes being coupled to said collectors of said first and second transistors;

a fourth transistor having first, second and control electrodes, said first electrode being coupled to said second supply voltage terminal, said second electrode being coupled to said circuit means and to said base of said second transistor, and said control electrode being coupled to said second electrode of said third transistor;

a first resistor coupled between said emitter of said first and second transistors and said first supply voltage terminal;

a second resistor coupled between said base of said first transistor and said second supply voltage terminal; and first and second diodes coupled between said base of said first transistor and said first supply voltage terminal.

3. The circuit according to claim 2 wherein said feedback means includes:

a first transistor having first, second and control electrodes, said first electrode being coupled to said second supply voltage terminal, and said control electrode being coupled to said output of said circuit means;

a second transistor having first, second and control electrodes, said first and control electrodes being coupled to said second electrode of said first transistor of said feedback means, and said second electrode being coupled to said first supply voltage terminal; and a third transistor having first, second and control electrodes, said first electrode being coupled to said control electrode of said first transistor of said feedback means, said second electrode being coupled to said first supply voltage terminal, and said control electrode being coupled to said control electrode of said second transistor of said feedback means.

4. The circuit according to claim 3 wherein said circuit means includes:

a first transistor having a collector, a base and an emitter, said emitter being coupled to said first supply voltage terminal;

a second transistor having a collector, a base and an emitter, said collector being coupled to said base of said first transistor of said circuit means, and said emitter being coupled to said first supply voltage terminal;

a third transistor having a collector, a base and an emitter, said collector and said base being coupled to said base of said second transistor of said circuit means, and said emitter being coupled to said first supply voltage terminal;

a fourth transistor having a collector, a base and an emitter, said collector being coupled to said second supply voltage terminal, said base being coupled to said second electrode of said fourth transistor of said start-up and bias-means, to said collector of said first transistor of said circuit means and to said output of said circuit means, and said emitter being coupled to said collectors of said second and third transistors of said circuit means;

a first resistor coupled between said emitter of said second transistor of said circuit means and said first supply voltage terminal;

a second resistor coupled between said emitter of said fourth transistor of said circuit means and said collector of said third transistor of said circuit means; and a third resistor coupled between said emitter of said fourth transistor of said circuit means and said collector of said second transistor of said circuit means.

5. The circuit according to claim 4 wherein said output means includes:

a first transistor having a collector, a base and an emitter, said collector being coupled to said second supply voltage terminal, said base being coupled to said output of said circuit means, and said emitter being coupled to said first supply voltage terminal and to the output of the circuit; and a resistor coupled between said emitter of said first transistor of said output means and said first supply voltage terminal.

6. A circuit having an output, comprising;

circuit means for providing a predetermined voltage at an output;

start-up and bias circuit means coupled to said circuit means for providing a start-up current to said circuit means during power-up and for providing a bias current to said circuit means after power-up, said bias current being generated from said predetermined voltage of said circuit means and being substantially independent of temperature;

feedback means coupled to said circuit means for maintaining said bias current to said circuit means substantially independent of power supply variations; and output means coupled to said output of said circuit means for providing a predetermined output voltage at the output of the circuit, said predetermined output voltage being independent of power supply variations.

7. The circuit according to claim 6 wherein said start-up and bias circuit means includes:

a first transistor having a collector, a base and an emitter, said base being coupled to first and second supply voltage terminals, and said emitter being coupled to said first supply voltage terminal;

a second transistor having a collector, a base and an emitter, said collector being coupled to said collector of said first transistor, said base being coupled to said circuit means, and said emitter being coupled to said emitter of said first transistor;

a third transistor having first, second and control electrodes, said first electrode being coupled to said second supply voltage terminal, and said second and control electrodes being coupled to said collectors of said first and second transistors;

a fourth transistor having first, second and control electrodes, said first electrode being coupled to said second supply voltage terminal, said second electrode being coupled to said circuit means, and said control electrode being coupled to said second electrode of said third transistor;

a first resistor coupled between said emitter of said first and second transistors and said first supply voltage terminal;

a second resistor coupled between said base of said first transistor and said second supply voltage terminal; and a diode coupled between said base of said first transistor and said first supply voltage terminal.

8. The circuit according to claim 7 wherein said feedback means includes:

a first transistor having first, second and control electrodes, said first electrode being coupled to said second supply voltage terminal, and said control electrode being coupled to said output of said circuit means;

a second transistor having first, second and control electrodes, said first and control electrodes being coupled to said second electrode of said first transistor of said feedback means, and said second electrode being coupled to said first supply voltage terminal; and a third transistor having first, second and control electrodes, said first electrode being coupled to said control electrode of said feedback means, said second electrode being coupled to said first supply voltage terminal, and said control electrode being coupled to said control electrode of said second transistor of said feedback means.

9. The circuit according to claim 8 wherein said circuit means includes:

a first transistor having a collector, a base and an emitter, said base being coupled to said first supply voltage terminal, and said emitter being coupled to a first supply voltage terminal;

a second transistor having a collector, a base and an emitter, said collector being coupled to said base of said first transistor, and said emitter being coupled to said first supply voltage terminal;

a third transistor having a collector, a base and an emitter said collector and said base being coupled to said base of said second transistor, and said emitter being coupled to said first supply voltage terminal;

a fourth transistor having a collector, a base and an emitter, said collector being coupled to said second supply voltage terminal, said base being coupled to said second electrode of said fourth transistor of said start-up and bias circuit means, to said collector of said first transistor of said circuit means and to said output of said circuit means, and said emitter being coupled to said collectors of said second and third transistors and to said base of said second transistor of said start-up and bias circuit means;

a first resistor coupled between said emitter of said second transistor of said circuit means and said first supply voltage terminal;

a second resistor coupled between said emitter of said fourth transistor of said circuit means and said collector of said third transistor of said circuit means;

a third resistor coupled between said emitter of said fourth transistor of said circuit means and said collector of said second transistor of said circuit means; and a fourth resistor coupled between said base of said first transistor of said circuit means and said first supply voltage terminal.

10. The circuit according to claim 9 wherein said output means includes:

a first transistor having a collector, a base and an emitter, said collector being coupled to said second supply voltage terminal, said base being coupled to said output of said circuit means, and said emitter being coupled to said first supply voltage terminal and to the output of the circuit; and a series combination of a resistor and a diode coupled between said emitter of said first transistor of said output means and said first supply voltage terminal.

11. A circuit, comprising:

a first transistor having a collector, a base and an emitter, said base being coupled to first and second supply voltage terminals, and said emitter being coupled to said first supply voltage terminal;

a second transistor having a collector, a base and an emitter, said collector being coupled to said collector of said first transistor, and said emitter being coupled to said emitter of said first transistor;

a third transistor having first, second and control electrodes, said first electrode being coupled to said second supply voltage terminal, and said second and control electrodes being coupled to said collectors of said first and second transistors;

a fourth transistor having first, second and control electrodes, said first electrode being coupled to said second supply voltage terminal, said second electrode being coupled to said base of said second transistor, and said control electrode being coupled to said second electrode of said third transistor;

a fifth transistor having a collector, a base and an emitter, said collector being coupled said second supply voltage terminal, and said base being coupled to said second electrode of said fourth transistor;

a sixth transistor having a collector, a base and an emitter, said collector being coupled to said base of said fifth transistor, and said emitter being coupled to said first supply voltage terminal;

a seventh transistor having a collector, a base and an emitter, said collector being coupled to said base of said sixth transistor and to said emitter of said fifth transistor, and said emitter being coupled to said first supply voltage terminal;

an eighth transistor having a collector, a base and an emitter, said collector being coupled to said base of said seventh transistor and to said emitter of said fifth transistor, said base being coupled to said collector of said eighth transistor, and said emitter being coupled to said first supply voltage terminal;

a ninth transistor having first, second and control electrodes, said first electrode being coupled to said second supply voltage terminal, and said control electrode being coupled to said collector of said sixth transistor;

a tenth transistor having first, second and control electrodes, said first and control electrodes being coupled to said second electrode of said ninth transistor, and said second electrode being coupled to said first supply voltage terminal;

an eleventh transistor having first, second and control electrodes, said first electrode being coupled to said control electrode of said ninth transistor, said second electrode being coupled to said first supply voltage terminal, and said control electrode being coupled to said control electrode of said tenth transistor;

a twelfth transistor having a collector, a base and an emitter, said collector being coupled to said second supply voltage terminal, said base being coupled to collector of said sixth transistor, and said emitter being coupled to said first supply voltage terminal and to an output terminal of the circuit;

a first resistor coupled between said emitter of said first and second transistors and said first supply voltage terminal;

a second resistor coupled between said base of said first transistor and said second supply voltage terminal;

a third resistor coupled between said emitter of said seventh transistor and said first supply voltage terminal;

a fourth resistor coupled between said emitter of said fifth transistor and said collector of said eighth transistor;

a fifth resistor coupled between said emitter of said fifth transistor and said collector of said seventh transistor;

a sixth resistor coupled between said emitter of said twelfth transistor and said first supply voltage terminal; and first and second diodes coupled between said base of said first transistor and said first supply voltage terminal.

12. A circuit, comprising:

a first transistor having a collector, a base and an emitter, said base being coupled to first and second supply voltage terminals, and said emitter being coupled to said first supply voltage terminal;

a second transistor having a collector, a base and an emitter, said collector being coupled to said collector of said first transistor, and said emitter being coupled to said emitter of said first transistor;

a third transistor having first, second and control electrodes, said first electrode being coupled to said second supply voltage terminal, and said second and control electrodes being coupled to said collectors of said first and second transistors;

a fourth transistor having first, second and control electrodes, said first electrode being coupled to said second supply voltage terminal, and said control electrode being coupled to said second electrode of said third transistor;

a fifth transistor having a collector, a base and an emitter, said collector being coupled said second supply voltage terminal, said base being coupled to said second electrode of said fourth transistor, and said emitter being coupled to said base of said second transistor;

a sixth transistor having a collector, a base and an emitter, said collector being coupled to said base of said fifth transistor, and said base and said emitter being coupled to said first supply voltage terminal;

a seventh transistor having a collector, a base and an emitter, said collector being coupled to said base of said sixth transistor and to said emitter of said fifth transistor, and said emitter being coupled to said first supply voltage terminal;

an eighth transistor having a collector, a base and an emitter, said collector being coupled to said base of said seventh transistor and to said emitter of said fifth transistor, said base being coupled to said collector of said eighth transistor, and said emitter being coupled to said first supply voltage terminal;

a ninth transistor having first, second and control electrodes, said first electrode being coupled to said second supply voltage terminal, and said control electrode being coupled to said collector of said sixth transistor;

a tenth transistor having first, second and control electrodes, said first and control electrodes being coupled to said second electrode of said ninth transistor, and said second electrode being coupled to said first supply voltage terminal;

an eleventh transistor having first, second and control electrodes, said first electrode being coupled to said control electrode of said ninth transistor, said second electrode being coupled to said first supply voltage terminal, and said control electrode being coupled to said control electrode of said tenth transistor;

a twelfth transistor having a collector, a base and an emitter, said collector being coupled to said second supply voltage terminal, said base being coupled to collector of said sixth transistor, and said emitter being coupled to said first supply voltage terminal and to an output terminal of the circuit;

a first resistor coupled between said emitter of said first and second transistors and said first supply voltage terminal;

a second resistor coupled between said base of said first transistor and said second supply voltage terminal;

a third resistor coupled between said emitter of said seventh transistor and said first supply voltage terminal;

a fourth resistor coupled between said emitter of said fifth transistor and said collector of said eighth transistor;

a fifth resistor coupled between said emitter of said fifth transistor and said collector of said seventh transistor;

a sixth resistor coupled between said base of said sixth transistor and said first supply voltage terminal;

a first diode coupled between said base of said first transistor and said first supply voltage terminal; and a series combination of a seventh resistor and a second diode coupled between said emitter of said twelfth transistor and said first supply voltage terminal.

13. An improved voltage reference circuit including a bandgap circuit for providing a predetermined voltage at an output and an output circuit coupled to the output of the bandgap circuit for providing an output voltage at an output of the circuit, wherein the improvement comprises:

start-up and bias circuit means coupled to the bandgap circuit for providing a start-up current to the bandgap circuit during power-up and for providing a bias current to the bandgap circuit after power-up, said bias current being generated from the predetermined voltage of the bandgap circuit; and feedback means coupled to the bandgap circuit for maintaining said bias current to the bandgap circuit substantially independent of power supply variations, the output voltage at the output of the circuit being independent of temperature and power supply variations.

14. The voltage reference circuit according to claim 13 wherein said start-up and bias circuit means includes:

a first transistor having a collector, a base and an emitter, said base being coupled to first and second supply voltage terminals, and said emitter being coupled to said first supply voltage terminal;

a second transistor having a collector, a base and an emitter, said collector being coupled to said collector of said first transistor, and said emitter being coupled to said emitter of said first transistor;

a third transistor having first, second and control electrodes, said first electrode being coupled to said second supply voltage terminal, and said second and control electrodes being coupled to said collectors of said first and second transistors;

a fourth transistor having first, second and control electrodes, said first electrode being coupled to said second supply voltage terminal, said second electrode being coupled to said circuit means and to said base of said second transistor, and said control electrode being coupled to said second electrode of said third transistor;

a first resistor coupled between said emitter of said first and second transistors and said first supply voltage terminal;

a second resistor coupled between said base of said first transistor and said second supply voltage terminal; and first and second diodes coupled between said base of said first transistor and said first supply voltage terminal.

15. The circuit according to claim 14 wherein said feedback means includes:

a first transistor having first, second and control electrodes, said first electrode being coupled to said second supply voltage terminal, and said control electrode being coupled to said output of the bandgap circuit;

a second transistor having first, second and control electrodes, said first and control electrodes being coupled to said second electrode of said first transistor of said feedback means, and said second electrode being coupled to said first supply voltage terminal; and a third transistor having first, second and control electrodes, said first electrode being coupled to said control electrode of said feedback means, said second electrode being coupled to said first supply voltage terminal, and said control electrode being coupled to said control electrode of said second transistor of said feedback means.

16. The circuit according to claim 15 wherein the bandgap circuit includes:

a first transistor having a collector, a base and an emitter, said emitter being coupled to said first supply voltage terminal;

a second transistor having a collector, a base and an emitter, said collector being coupled to said base of said first transistor of the bandgap circuit, and said emitter being coupled to said first supply voltage terminal;

a third transistor having a collector, a base and an emitter, said collector and said base being coupled to said base of said second transistor of the bandgap circuit, and said emitter being coupled to said first supply voltage terminal;

a fourth transistor having a collector, a base and an emitter, said collector being coupled to said second supply voltage terminal, said base being coupled to said second electrode of said fourth transistor of said start-up and bias-means, to said collector of said first transistor of the bandgap circuit and to said output of the bandgap circuit, and said emitter being coupled to said collectors of said second and third transistors of the bandgap circuit;

a first resistor coupled between said emitter of said second transistor of the bandgap circuit and said first supply voltage terminal;

a second resistor coupled between said emitter of said fourth transistor of the bandgap circuit and said collector of said third transistor of the bandgap circuit; and a third resistor coupled between said emitter of said fourth transistor of the bandgap circuit and said collector of said second transistor of the bandgap circuit.

* * * * *